US007031630B2

(12) United States Patent
Endo

(10) Patent No.: US 7,031,630 B2
(45) Date of Patent: Apr. 18, 2006

(54) IMAGE FORMING DEVICE THAT PERFORMS WARM-UP OPERATION

(75) Inventor: Yoshinori Endo, Toyota (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 251 days.

(21) Appl. No.: 10/705,933

(22) Filed: Nov. 13, 2003

(65) Prior Publication Data

US 2004/0136744 A1 Jul. 15, 2004

(30) Foreign Application Priority Data

Nov. 14, 2002 (JP) ..... 2002-331083

(51) Int. Cl.
*G03G 15/20* (2006.01)

(52) U.S. Cl. ..... 399/70

(58) Field of Classification Search ..... None
See application file for complete search history.

(56) References Cited

U.S. PATENT DOCUMENTS

| | | | | |
|---|---|---|---|---|
| 4,385,826 | A * | 5/1983 | Itoh | 399/70 |
| 4,737,818 | A * | 4/1988 | Tanaka et al. | 399/70 |
| 4,996,567 | A * | 2/1991 | Watarai et al. | 399/70 |
| 5,001,519 | A * | 3/1991 | Saito | 399/69 |
| 5,448,339 | A * | 9/1995 | Kokaji et al. | 399/69 |
| 5,899,599 | A * | 5/1999 | Kato | 399/69 |
| 6,175,699 | B1 * | 1/2001 | Kato et al. | 399/69 |

FOREIGN PATENT DOCUMENTS

| | | |
|---|---|---|
| EP | 0 070 740 A2 | 1/1983 |
| JP | A 58-014871 | 1/1983 |
| JP | A 58-18664 | 2/1983 |
| JP | A 64-49074 | 2/1989 |
| JP | A 2-176689 | 7/1990 |
| JP | A 8-185086 | 7/1996 |
| JP | A 10-207280 | 8/1998 |

* cited by examiner

*Primary Examiner*—Robert Beatty
(74) *Attorney, Agent, or Firm*—Oliff & Berridge PLC

(57) ABSTRACT

When the surface temperature of a heat roller is less than a toner melting temperature, the heat roller is not driven to rotate in a warm-up operation until the surface temperature of the heat roller reaches a rotatable temperature after a heater is turned ON. However, when the surface temperature drops below the rotatable temperature after the surface temperature once reached the rotatable temperature, the heat roller is immediately driven to rotate after the heater is turned ON, provided the temperature remains above a check temperature.

15 Claims, 6 Drawing Sheets

TEMPERATURE
FIXING TEMPERATURE Tp
WAITING TEMPERATURE Tr
COLD START MOTOR ROTATABLE TEMPERATURE Ts
CHECK TEMPERATURE Tc
TONER MELTING TEMPERATURE Tm
FRONT COVER OPENED
FRONT COVER CLOSED
A
B C
D
E
F
G
TIME

HEATER
ON
OFF

MOTOR START FLAG
1
0

MAIN MOTOR IN WARM-UP OPERATION
ON
OFF
WARM-UP OPERATION
WARM-UP OPERATION

TEMPERATURE
FIXING TEMPERATURE Tp
WAITING TEMPERATURE Tr
COLD START MOTOR ROTATABLE TEMPERATURE Ts
CHECK TEMPERATURE Tc
TONER MELTING TEMPERATURE Tm
FRONT COVER OPENED
FRONT COVER CLOSED
A
B C
D
F
G
TIME

HEATER
ON
OFF

MOTOR START FLAG
1
0

MAIN MOTOR IN WARM-UP OPERATION
ON
OFF
WARM-UP OPERATION
WARM-UP OPERATION

TEMPERATURE
FIXING TEMPERATURE Tp
WAITING TEMPERATURE Tr
COLD START MOTOR ROTATABLE TEMPERATURE Ts
CHECK TEMPERATURE Tc
TONER MELTING TEMPERATURE Tm
FRONT COVER OPENED
FRONT COVER CLOSED
A
C
D
E
G
TIME
T3
T1
T2
10sec

HEATER
ON
OFF

MOTOR START FLAG
1
0
FIG.8(c')
MOTOR START FLAG
1
0

MAIN MOTOR
ON
OFF
FIG.8(d')
MAIN MOTOR
ON
OFF

IMAGE FORMING DEVICE THAT PERFORMS WARM-UP OPERATION

BACKGROUND OF THE INVENTION

1. Field of the Invention

The present invention relates to an image: forming device.

2. Related Art

Normally, image forming devices, such as laser printers, are provided with thermal fixing devices for performing fixing operations. The thermal fixing device includes a heat roller equipped with an internal heater, and a pressure roller that applies pressure to the heat roller. Toner image transferred onto a recording sheet is fixed by heat as the paper passes between the heat roller and the pressure roller.

In some of this type of thermal fixing device, a cleaner is disposed in contact with the surface of the heat roller for cleaning toner adhering to the surface of the heat roller during the fixing operation.

Japanese unexamined patent application publication No. HEI-2-176689 describes one example of a cleaning method. In this method, the heat roller is rotated a prescribed number of times while the periphery of the heat roller contacts the cleaner a plurality of times in order to remove the large amount of resin and coloring agent adhering to the periphery of the heat roller. This cleaning operation is performed after an operation-halt period is over, for example, when paper jam is cleared.

However, the toner removed from the surface of the heat roller adheres to and solidifies on the cleaner. Therefore, if the heat roller starts rotating before the solidified toner on the cleaner is sufficiently melted, the toner can generate abnormal noises from scraping and can damage the heat roller and the like. Hence, during a warm-up operation executed to prepare for a printing operation, the internal heater of the heat roller is first turned ON, and the process waits until the surface of the heat roller reaches a predetermined temperature so that the toner fixed to the cleaner is sufficiently melted by the time of when the heat roller is driven to rotate.

Once the heat roller reaches the predetermined temperature, the toner on the cleaner is sufficiently melted by heat. Hence, when the warm-up operation is executed directly thereafter, the toner adhering to the cleaner has already been melted, even if the temperature of the heat roller has dropped below the predetermined temperature. Therefore, if the process in the image forming device always waits until the heat roller reaches the predetermined temperature before start driving the heat roller to rotate, this waiting time becomes wasteful and prevents the image forming device from achieving high-speed printing processes.

SUMMARY OF THE INVENTION

In the view of foregoing, it is an object of the present invention to overcome the above problems, and also to provide an image forming device capable of achieving a high-speed printing process by beginning to drive a fixing member based on the prior heating status of the fixing member.

In order to attain the above and other object, the present invention provides an image forming device including a fixing member, a heater, a first detecting member, a driving member, a contact member, a controller, and a second detecting member. The fixing member performs a fixing operation to fix a developer onto a fixing medium and has a surface. The developer has a melting temperature that is a first temperature. The heater generates heat to heat the fixing member. The first detecting member detects a surface temperature of the fixing member. The driving member rotates the fixing member. The contact member constantly contacts the surface of the fixing member. The controller controls the heater and the driving member. The second detecting member detects whether or not the surface temperature of the fixing member has dropped below a third temperature after the surface temperature has previously reached a second temperature higher than the first temperature. The third temperature is equal to or higher than the first temperature and lower than the second temperature. The controller controls the heater to start generating heat at a predetermined timing. If the surface temperature of the fixing member detected at the predetermined timing by the first detecting member is lower than the third temperature, the controller controls the driving member to start rotating the fixing member after the surface temperature of the fixing member exceeds the second temperature. If, at the predetermined timing, the second detecting member detects that the surface temperature of the fixing member has not dropped below the third temperature after the surface temperature has previously reached the second temperature, the controller controls the driving member to start rotating the fixing member.

There is also provided an image forming device including a fixing member, a heater, a first detecting member, a driving member, a contact member, a controller, and a second detecting member. The fixing member performs a fixing operation to fix a developer onto a fixing medium and has a surface. The developer has a melting temperature that is a first temperature. The heater generates heat to heat the fixing member. The first detecting member detects a surface temperature of the fixing member. The driving member rotates the fixing member. The contact member constantly contacts the surface of the fixing member. The controller controls the heater and the driving member. The second detecting member detects whether or not the surface temperature of the fixing member has dropped below a third temperature after the surface temperature has previously reached a second temperature higher than the first temperature. The third temperature is equal to or higher than the first temperature and lower than the second temperature. The controller controls the heater to start generating heat at a predetermined timing. If the surface temperature of the fixing member detected, at the predetermined timing, by the first detecting member is lower than the third temperature, the controller controls the driving member to start rotating the fixing member after a first predetermined time has elapsed after the surface temperature of the fixing unit reached the third temperature by controlling the heater. If, at the predetermined timing, the second detecting member detects that the surface temperature of the fixing member has not dropped below the third temperature after the surface temperature has previously reached the second temperature, the controller controls the driving member to start rotating the fixing member after a second predetermined time has elapsed after the controller controlled the heater to start generating heat, the second predetermined time being shorter than the first predetermined time.

BRIEF DESCRIPTION OF THE DRAWINGS

In the drawings:

FIG. 6(*b*) is a time chart showing ON/OFF of the fixing heater;

FIG. 6(*c*) is a time chart showing the flag status of a motor start flag;

FIG. 6(*d*) is a time chart showing ON/OFF of the main motor during a warm-up operation;

FIG. 7(*b*) is a time chart showing ON/OFF of the fixing heater;

FIG. 7(*c*) is a time chart showing the flag status of the motor start flag;

FIG. 7(*d*) is a time chart showing ON/OFF of the main motor during a warm-up operation;

FIG. 8(*b*) is a time chart showing ON/OFF of the fixing heater;

FIG. 8(*c*) is a time chart showing the flag status of the motor start flag for when the time duration T3 is equal to or less than 10 seconds, according to a modification of the embodiment;

FIG. 8(*c'*) is a time chart showing the flag status of the motor start flag for when the time duration T3 exceeds 10 seconds, according to the modification of the embodiment;

FIG. 8(*d*) is a time chart showing ON/OFF of the main motor during a warm-up operation for when the time duration T3 is equal to or less than 10 seconds, according to the modification of the embodiment; and FIG. 8(*d'*) is a time chart showing ON/OFF of the main motor during a warm-up operation for when the time duration T3 exceeds 10 seconds, according to the modification of the embodiment.

PREFERRED EMBODIMENT OF THE PRESENT INVENTION

Next, a laser printer according to an embodiment of the present invention will be described with reference to the accompanying drawings.

Figure 1:
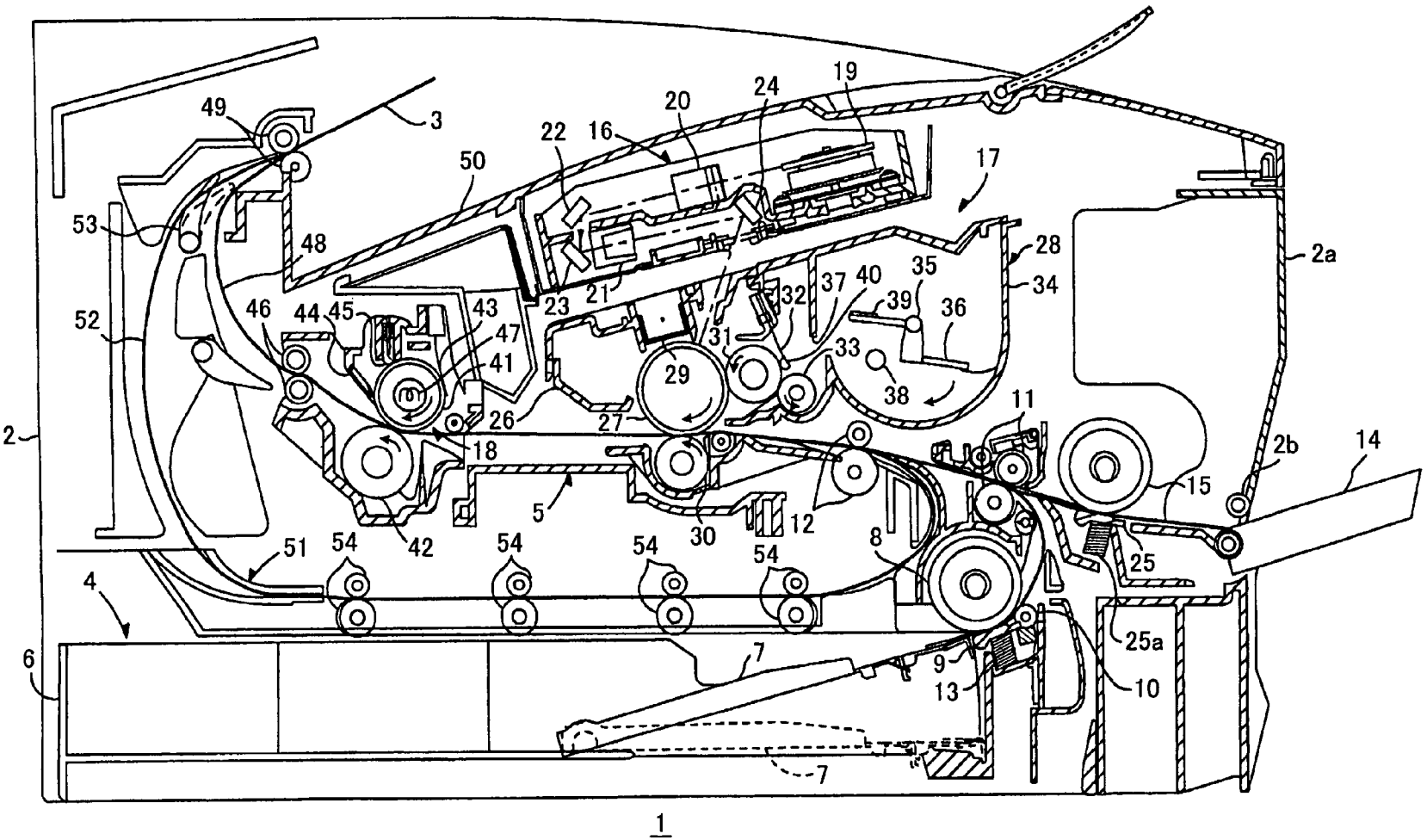
FIG. 1 is a cross-sectional side view showing a laser printer according to a preferred embodiment of the present invention.

As shown in FIG. 1, a laser printer 1 of the present embodiment includes a main casing 2, a feeder unit 4, and an image forming unit 5. A front cover 2*a* is disposed on the front surface of the main casing 2 so as to be pivotable via a hinge 2*b* provided on the bottom edge of the front cover 2*a* The front cover 2*a* is configured to open and close in relation to the main casing 2 by swinging the top end of the front cover 2*a* in the front-to-back direction. The feeder unit 4 and the image forming unit 5 are housed in the main casing 2. The feeder unit 4 supplies sheets 3 to the image forming unit 5. The image forming unit 5 forms desired images on the supplied sheets 3.

The feeder unit 4 includes a sheet supply tray 6, a sheet pressing plate 7, a sheet supply roller 8, a separation pad 9, paper dust removing rollers 10, 11, and registration rollers 12. The sheet pressing plate 7 is pivotally movably provided within the sheet supply tray 6. The sheet supply roller 8 and the separation pad 9 are provided above one end of the sheet supply tray 6. The paper dust removing rollers 10, 11 are disposed downstream from the sheet supply roller 8 with respect to a sheet transport direction in which the sheets 3 are transported. The registration rollers 12 are provided downstream from the paper dust removing rollers 10, 11 in the sheet transport direction.

The sheet pressing plate 7 is capable of supporting a stack of sheets 3. The sheet pressing plate 7 is pivotably supported at its end furthest from the supply roller 8 so that the end of the sheet pressing plate 7 that is nearest the supply roller 8 can move upward and downward. Although not shown in the drawings, a spring for urging the sheet pressing plate 7 upward is provided to the rear surface of the sheet pressing plate 7. Therefore, the sheet pressing plate 7 pivots downward around the end of the sheet pressing plate 7 farthest from the sheet supply roller 8 in accordance with increase in the amount of sheets 3 stacked on the sheet pressing plate 7, against the urging force of the spring. The sheet supply roller 8 and the separation pad 9 are disposed in confrontation with each other. A spring 13 is provided beneath the separation pad 9 for pressing the separation pad 9 toward the sheet supply roller 8. Urging force of the spring under the sheet pressing plate 7 presses the uppermost sheet 3 on the sheet pressing plate 7 toward the supply roller 8 so that rotation of the supply roller 8 moves the uppermost sheet 3 between the supply roller 8 and the separation pad 9. In this way, one sheet 3 at a time is separated from the stack and supplied to the paper dust removing rollers 10, 11.

The paper dust removing rollers 10, 11 remove paper dust from the supplied sheets 3 and further convey them to the registration rollers 12. The pair of registration rollers 12 performs a desired registration operation on the supplied sheets 3 and transports the same to an image formation position where a photosensitive drum 27 and a transfer roller 30 contact each other. In other words, the image formation position is a transfer position where a visible toner image is transferred from the surface of the photosensitive drum 27 to a sheet 3 as the sheet 3 passes between the photosensitive drum 27 and the transfer roller 30.

The feeder unit 4 further includes a multipurpose tray 14, a multipurpose sheet supply roller 15, and a multipurpose sheet supply pad 25. The multipurpose sheet supply roller 15 and the multipurpose sheet supply pad 25 are disposed in confrontation with each other for supplying sheets 3 stacked on the multipurpose tray 14. A spring 25*a* provided beneath the multipurpose sheet supply pad 25 presses the multipurpose sheet supply pad 25 up toward the multipurpose sheet supply roller 15. Rotation of the multipurpose sheet supply roller 15 moves sheets 3 one at a time from the stack on the multipurpose tray 14 to a position between the multipurpose sheet supply pad 25 and the multipurpose sheet supply roller 15 so that the sheets 3 on the multipurpose tray 14 can be supplied one at a time to the image formation position.

The image forming section 5 includes a scanner section 16, a process unit 17, and a fixing section 18. The scanner section 16 is provided at the upper section of the main casing 2 and is provided with a laser emitting section (not shown), a rotatingly driven polygon mirror 19, lenses 20, 21, and reflection mirrors 22, 23, 24. The laser emitting section emits a laser beam based on desired image data. As indicated by single-dot chain line in FIG. 1, the laser beam passes through or is reflected by the mirror 19, the lens 20, the reflection mirrors 22 and 23, the lens 21, and the reflection mirror 24 in this order so as to irradiate, in a high speed scanning operation, the surface of the photosensitive drum 27 of the process unit 17.

The process unit 17 is disposed below the scanner section 16. The process unit 17 includes a drum cartridge 26 detachably mounted in the main casing 2. The drum cartridge 26 can be mounted in and removed from the main casing 2 or removed by opening the front cover 2*a*. The drum cartridge 26 houses the photosensitive drum 27, a developing cartridge 28, a scorotron charger 29, and a transfer roller 30.

The developing cartridge 28 is detachably mounted on the drum cartridge 26 and includes a developing roller 31, a thickness regulating blade 32, a supply roller 33, and a toner hopper 34.

The toner hopper 34 is filled with positively charging, non-magnetic, single-component toner. In the present embodiment, polymerization toner is used as the toner. Polymerization toner has substantially spherical particles and so has an excellent fluidity characteristic. To produce polymerization toner, a polymerizing monomer is subjected to well-known polymerizing processes, such as suspension polymerization. Examples of a polymerizing monomer include a styrene type monomer or an acrylic type monomer. An example of a styrene type monomer is styrene. Examples of acrylic type monomers are acrylic acid, acrylic (C1–C4) acrylate, and acrylic (C1–C4) metaacrylate. Because the polymerization toner has such an excellent fluidity characteristic, image development is reliably performed so that high-quality images can be formed. A coloring agent such as carbon black, wax, and the like are mixed in the polymeric toner. An externally added agent such as silica is also added in order to improve fluidity. A particle diameter of the polymeric toner is approximately 6 to 10 μm.

A rotating shaft 35 is disposed in the center of the toner hopper 34. An agitator 36 is supported on the rotating shaft 35 for agitating toner accommodated in the toner hopper 34. Toner agitated by the agitator 36 is discharged through a toner supply hole 37 formed in the side of the toner hopper 34. The agitator 36 is driven to rotate clockwise, as indicated by an arrow in FIG. 1, by a motive force inputted from the main motor 65. Windows 38 are disposed one in each side wall of the toner hopper 34, enabling detection of the amount of toner remaining in the toner hopper 34. A cleaner 39 is supported on the rotating shaft 35 for cleaning the windows 38.

The supply roller 33 is rotatably disposed to the side of the toner supply hole 37. The developing roller 31 is rotatably disposed in confrontation with the supply roller 33. The supply roller 33 and the developing roller 31 contact each other with a degree of pressure.

The supply roller 33 includes a metal roller shaft covered by a roller formed of a conductive foam material. The supply roller 33 is driven to rotate in a counterclockwise direction as indicated by an arrow in FIG. 1 by a motive force inputted from the main motor 65.

The developing roller 31 includes a metal roller shaft covered by a roller that is formed of an electrically conductive rubber material. More specifically, the roller of the developing roller 31 is formed of an electrically conductive urethane rubber or silicon rubber including fine carbon particles, the surface of which is coated with a urethane rubber or silicon rubber including fluorine. A developing bias is applied to the developing roller 31. The developing roller 31 is driven to rotate in the counterclockwise direction indicated by an arrow in FIG. 1 by a motive force inputted from the main motor 65.

The thickness regulating blade 32 is disposed near the developing roller 31. The thickness regulating blade 32 includes a blade body formed of a metal leaf spring, and a pressing part 40 disposed on the end of the blade body. The pressing part 40 is formed of an insulating silicon rubber to have a circular cross-sectional shape. The thickness regulating blade 32 is supported by the developing cartridge 28, such that the pressing part 40 applies pressure to the developing roller 31 by the urging force of the blade body.

Toner discharged through the toner supply hole 37 is supplied to the developing roller 31 by the rotation of the supply roller 33. At this time, the toner is positively tribocharged between the supply roller 33 and the developing roller 31. Further, toner supplied onto the developing roller 31 is carried between the pressing part 40 of the thickness regulating blade 32 and the developing roller 31 with the rotation of the developing roller 31, forming a thin layer of toner having a uniform thickness on the developing roller 31.

The photosensitive drum 27 is rotatably supported in the drum cartridge 26 to the side of the developing roller 31 and in confrontation with the developing roller 31. The photosensitive drum 27 is formed of a main drum, that is grounded. The surface of the main drum is a positively charged photosensitive layer formed of polycarbonate or the like. The photosensitive drum 27 is driven to rotate clockwise as indicated by an arrow in FIG. 1 by the motive force inputted from the main motor 65.

The scorotoron charger 29 is disposed above the photosensitive drum 27 and is spaced away from the photosensitive drum 27 by a predetermined space so as to avoid direct contact with the photosensitive drum 27. The scorotron charger 29 is a positive-charge scorotron type charge unit for generating a corona discharge from a tungsten charge wire, for example, to uniformly charge the surface of the photosensitive drum 27 to a positive charge.

The transfer roller 30 is rotatably supported in the drum cartridge 26 at a position below and in confrontation with the photosensitive drum 27. The transfer roller 30 includes a metal roller shaft and a roller portion covering the roller shaft. The roller portion is made from electrically-conductive rubber material. At the time of toner image transfer, the transfer roller 30 is applied with a predetermined transfer bias with respect to the photosensitive drum 27. The transfer roller 30 is driven to rotate in the counterclockwise direction as indicated by an arrow in FIG. 1 by the motive force inputted from the main motor 65.

As the photosensitive drum 27 rotates, the Scorotron charger 29 forms a uniform positive charge over the surface of the rotating photosensitive drum 27. Subsequently, electrostatic latent images are formed on the surface of the photosensitive drum 27 by a laser beam emitted from the scanning unit 16. Then, the positively charged toner carried on the surface of the developing roller 31 is brought into contact with the photosensitive drum 27 as the developing roller 31 rotates. At this time, the latent images formed on the surface of the photosensitive drum 27 are transformed into toner images when the toner is selectively attracted to portions of the photosensitive drum 27 that were exposed to the laser beam and, therefore, have a lower potential than the rest of the surface having a uniform positive charge. In this way, reversal development is achieved.

The toner image carried on the surface of the photosensitive drum 27 is transferred to the recording sheet 3 by a transfer bias applied to the transfer roller 30 as the recording sheet 3 passes between the photosensitive drum 27 and the transfer roller 30.

Figure 2:
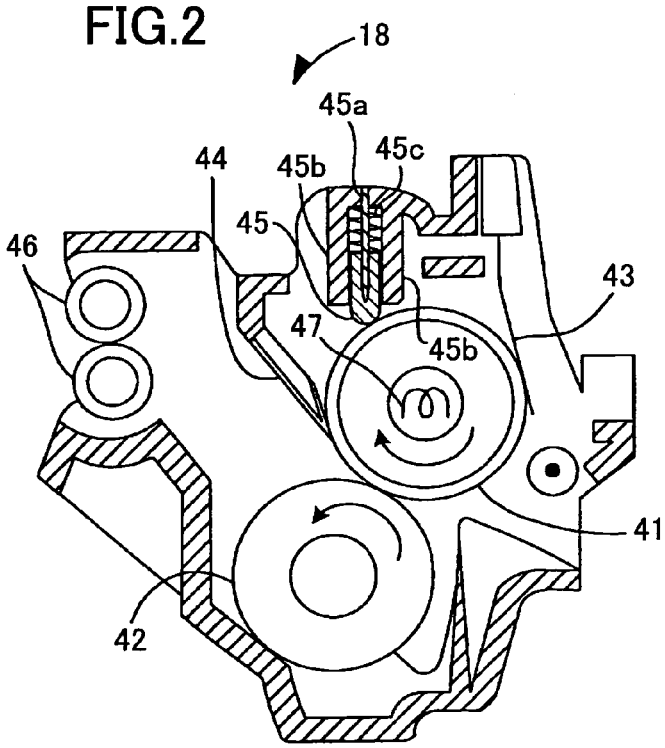
FIG. 2 is an enlarged cross-sectional side view showing a fixing unit of the laser printer in FIG. 1.

The fixing unit 18 is disposed to the side of and downstream from the processing unit 17 in the sheet transport direction. As shown in FIG. 2, the fixing unit 18 includes a heat roller 41, a heater 47, a thermistor 43, a stripping blade 44, a cleaner 45, a pressure roller 42, and a pair of conveying rollers 46. The conveying rollers 46 are disposed downstream from the heat roller 41 and the pressure roller 42.

The heat roller 41 is formed in a cylindrical shape by molding aluminum or another metal. The heat roller 41 is rotatably supported in the main casing 2 by both axial ends. The heat roller 41 is driven to rotate clockwise as indicated by an arrow in FIG. 1 by the motive force inputted from the main motor 65.

The heater 47 is a halogen heater or the like and is disposed in the axial center of the heat roller 41, extending along the axial direction of the heat roller 41. When the heater 47 is turned ON, the surface temperature of the heat roller 41 rises at a rate of 20° C./second, for example. When the heater 47 is turned OFF, the surface temperature of the heat roller 41 drops at a rate of 0.2–2° C./second, for example.

The thermistor 43 is a contact-type temperature sensor formed as a flat plate having elasticity. The base end of the thermistor 43 is supported on the main casing 2 such that the free end of the thermistor 43 contacts the surface of the heat roller 41 in the axial center of the heat roller 41 and on the upstream side of the contact point between the heat roller 41 and the pressure roller 42 in relation to the rotational direction of the heat roller 41, The thermistor 43 detects the surface temperature of the heat roller 41 and inputs this value to a central processing unit (CPU) 59 (FIG. 3) to be described later.

The stripping blade 44 is formed of a resin or the like to have a sharp leading edge. The stripping blade 44 is fixedly disposed along the axial direction of the heat roller 41 on the downstream side of the contact point between the heat roller 41 and the pressure roller 42 in relation to the rotational direction of the heat roller 41. The base end of the stripping blade 44 is supported on the main casing 2 such that the leading edge of the stripping blade 44 constantly contacts the surface of the heat roller 41 from a direction opposing the rotational direction of the heat roller 41. The sharp leading edge of the stripping blade 44 peels the recording sheet 3 from the surface of the heat roller 41 as the recording sheet 3 passes between the heat roller 41 and the pressure roller 42. That is, the stripping blade 44 decreases the occurrence of paper jams in the fixing unit 18 by easily peeling the recording sheet 3 from the surface of the heat roller 41 in this manner.

The cleaner 45 is formed of a rubber material, a sponge material, or the like. The cleaner 45 is disposed downstream of the stripping blade 44 and upstream of the thermistor 43 in the rotational direction of the heat roller 41 at a position corresponding to the thermistor 43 with respect to the axial direction of the heat roller 41. The cleaner 45 constantly contacts the heat roller 41 over a range greater than the width of the thermistor 43 in the axial direction of the heat roller 41. As shown in FIG. 2, the cleaner 45 is fixedly supported above the heat roller 41 and has a substantially U-shape. A support plate 45*a* extending along the axial direction of the heat roller 41 from the main casing 2 is interposed in the U shape of the cleaner 45, which in turn is interposed between opposing plates 45*b*. A spring 45*c* is disposed between the opposing plates 45*b* above the cleaner 45. The urging force of the spring 45*c* presses the bottom end of the cleaner 45 against the surface of the heat roller 41, enabling the cleaner 45 to clean toner from the surface of the heat roller 41 that has been deposited thereon from the recording sheet 3 passing between the heat roller 41 and the pressure roller 42. With this configuration, the cleaner 45 removes toner from the surface of the heat roller 41 which has been transferred from the recording sheet 3 onto the surface of the heat roller 41 during the fixing operation.

The pressure roller 42 includes a metal roller shaft covered by a roller formed of a rubber material. As shown in FIG. 1, the pressure roller 42 is rotatably supported in the main casing 2 at a position below the heat roller 41 and is pressed toward the heat roller 41 by a spring (not shown). When the heat roller 41 is driven to rotate, the pressure roller 42 follows the rotations of the heat roller 41.

During the fixing operation of a printing process, the CPU 59 controls ON and OFF of the heater 47 in order to maintain the surface temperature of the heat roller 41 at a predetermined fixing temperature. Toner transferred onto a recording sheet 3 when the recording sheet 3 passes between the photosensitive drum 27 and the transfer roller 30 is fixed by heat to the recording sheet 3 as the recording sheet 3 passes between the heat roller 41 and the pressure roller 42. Subsequently, the recording sheet 3 is conveyed along a discharge path 48 by the conveying rollers 46. Following the fixing operation, the recording sheet 3 is conveyed to discharge rollers 49 along the discharge path 48, and then the discharge rollers 49 discharge the recording sheet 3 onto a discharge tray 50.

Here, when the stripping blade 44 peels the recording sheet 3 from the surface of the heat roller 41, toner from the surface of the heat roller 41 becomes deposited on the stripping blade 44. Also, when the cleaner 45 removes toner from the surface of the heat roller 41, toner from the surface of the heat roller 41 becomes deposited on the cleaner 45.

The laser printer 1 further includes a reverse conveying unit 51 for enabling a duplex printing to print both sides of the sheet 3. The reverse conveying unit 51 includes the discharge rollers 49, a reverse conveying path 52, a flapper 53, and a plurality of reverse conveying rollers 54.

The discharge rollers 49 are a pair of rollers that can be selectively rotated forward and in reverse. The discharge rollers 49 are rotated forward to discharge sheets 3 onto the sheet-discharge tray 46 and rotated in reverse when sheets 3 are to be inverted.

The reverse conveying rollers 54 are disposed below the image forming unit 5. The reverse conveying path 52 extends vertically between the discharge rollers 49 and the reverse conveying rollers 54. The upstream end of the reverse conveying path 52 is located near the discharge rollers 49 and the downstream end is located near the reverse conveying rollers 54 so that sheets 3 can be transported downward from the discharge rollers 49 to the reverse conveying rollers 54.

The flapper 53 is pivotably provided at a branch point between the discharge path 48 and the reverse conveying path 52. By toggling the excitation of a solenoid (not shown) ON and OFF, the conveying direction of the recording sheet 3 reversed by the discharge rollers 49 can be switched from the direction toward the discharge path 48 to the direction toward the reverse conveying path 52.

The reverse conveying rollers 54 are disposed in a substantially horizontal direction above the discharge tray 6. The reverse conveying roller 54 farthest upstream is positioned near the downstream end of the reverse conveying path 52. The reverse conveying roller 54 farthest downstream is positioned below the registration rollers 12.

When forming images on both sides of the recording sheet 3, the reverse conveying unit 51 is operated as follows. After having an image formed on one surface, the recording sheet 3 is conveyed by the conveying rollers 46 to the discharge rollers 49 via the discharge path 48. With the recording sheet 3 interposed between the discharge rollers 49, the discharge rollers 49 rotate in a forward rotation, conveying the recording sheet 3 temporarily outward (toward the discharge tray 50), such that a large part of the recording sheet 3 is fed out of the main casing 2. When the trailing edge of the recording sheet 3 becomes interposed between the discharge rollers 49, the discharge rollers 49 halt their forward rotation. Next, the discharge rollers 49 rotate in the reverse direction, and also the flapper 53 switches the conveying direction to convey the recording sheet 3 toward the reverse conveying path 52. Hence, the recording sheet 3 is conveyed toward the reverse conveying path 52 leading now with the trailing edge. After the recording sheet 3 is conveyed into the reverse conveying path 52, the flapper 53 is switched to its original state, that is, the position for conveying the recording, sheet 3 supplied from the conveying rollers 46 toward the discharge rollers 49. Next, the recording sheet 3 conveyed along the reverse conveying path 52 in the reverse direction is conveyed to the reverse conveying rollers 54, which in turn convey the recording sheet 3 upward to the registration rollers 12. The registration rollers 12 adjust the recording sheet 3 to a proper register and convey the same toward the transfer position with its upper front and back surfaces switched, enabling images to be formed on both sides of the recording sheet 3.

In the laser printer 1, a warm-up operation is executed to initialize various mechanical components by driving the components to rotate idly while not supplying the recording sheet 3 from the feeding unit 4. These components are idly driven by driving of the main motor 65. The mechanical components driven to rotate in the warm-up operation include the agitator 36, the supply roller 33, the developing roller 31, the photosensitive drum 27, the transfer roller 30, and the heat roller 41. That is, the main motor 65 is driven to idly rotate the heat roller 41 and the like in the warm-up operation.

Figure 3:
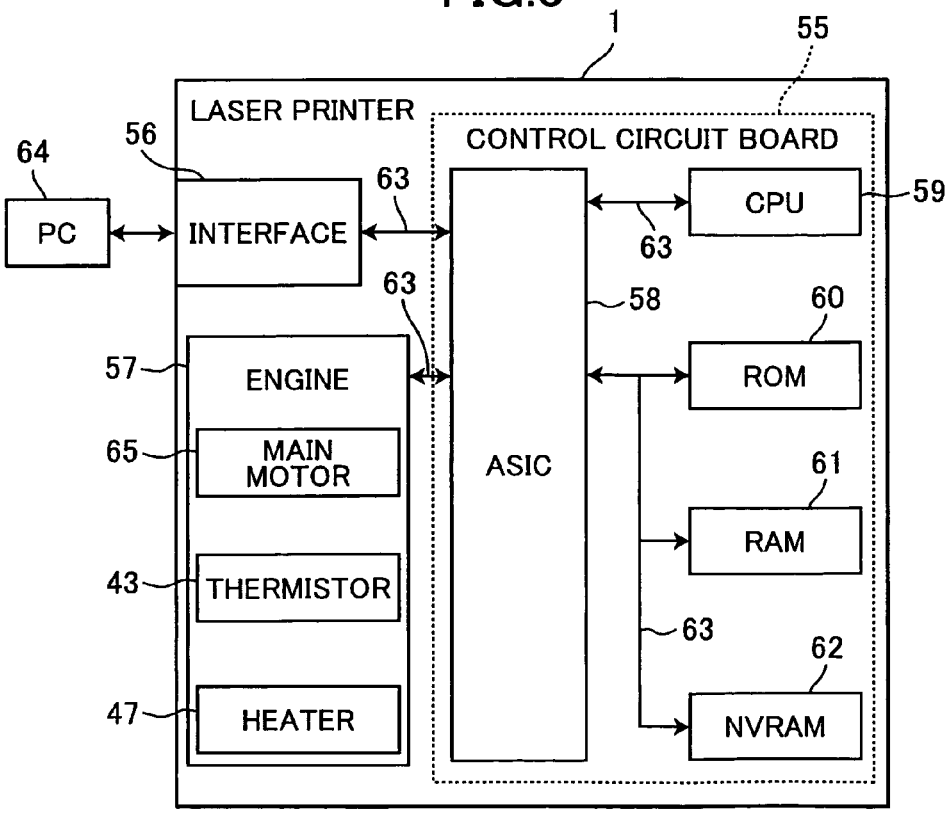
FIG. 3 is a block diagram showing electrical structure of the laser printer in FIG. 1.

The warm-up operation is executed at prescribed timings to prepare for a printing process. The prescribed timings include timings prior to executing a series of printing processes, when the power is turned ON to the laser printer 1, when the laser printer 1 is reset, when a paper jam or other error is cleared, when the laser printer 1 is revived from a sleep mode, when the front cover 2*a* is closed, and the like. FIG. 3 is a block diagram showing the electrical construction of the laser printer 1 used to implement this control process for executing the warm-up operation.

As shown in FIG. 3, the laser printer 1 includes a control circuit board 55, an interface 56, and an engine 57. The control circuit board 55 includes an application specific integrated circuit (ASIC) 58, the CPU 59, a read only memory (ROM) 60, a random access memory (RAM) 61, and a nonvolatile random access memory (NVRAM) 62.

The ASIC 58 is an integrated circuit for connecting the CPU 59, the ROM 60, the RAM 61, the NVRAM 62, the interface 56, and the engine 57. The CPU 59, the ROM 60, the RAM 61, and the NVRAM 62 are connected to the ASIC 58 within the control circuit board 55 by buses 63. The interface 56 and the engine 57 are connected to the ASIC 58 outside of the control circuit board 55 by buses 63.

The CPU 59 is the center of control in the laser printer 1 and controls each component therein. For example, the CPU 59 controls ON and OFF of the heater 47 based on detection signals from the thermistor 43 so as to maintain the surface temperature of the heat roller 41 at a predetermined fixing temperature during fixing operation and at a predetermined waiting temperature during non-fixing operation.

In order to ensure safety for a user, the CPU 59 halts the driving of the main motor 65 and turns OFF the heater 47 when the front cover 2*a* is opened during a printing process. The CPU 59 also halts the driving of the main motor 65 and turns OFF the heater 47 when the laser printer 1 enters a sleep state, when an error, such as a paper jam, occurs, or the like.

The ROM 60 stores various programs for controlling the laser printer 1, such as a print control program for executing a printing process. The print control program includes a warm-up operation determining program for determining the necessity for a warm-up process, a temperature check process program for checking the surface temperature of the heat roller 41, and the like. The RAM 61 is a memory for temporarily storing numerical values and other data. Data written to the RAM 61 includes the surface temperature of the heat roller 41 detected by the thermistor 43, and a motor start flag (FIG. 5) for determining whether to start driving (rotating) the main motor 65 during the warm-up operation.

The NVRAM 62 is a nonvolatile memory, meaning that data stored in the NVRAM 62 is not lost even when the laser printer 1 loses power or is reset. Data written to the NVRAM 62 includes the predetermined temperature of the heat roller 41. Specifically, the NVRAM 62 stores such data as a fixing temperature $T_p$, a waiting temperature $T_r$ a cold start motor rotatable temperature $T_S$, a check temperature $T_C$, and a toner melting temperature $T_m$.

The fixing temperature $T_p$ is the temperature at which a toner image is fixed to the recording sheet 3 during the fixing operation of a printing process and is set to 200° C., for example. The waiting temperature $T_r$ is the temperature used during a rest state of a printing process (in other words, during a non-fixing operation). The waiting temperature $T_r$ is set to a temperature, such as 160° C., from which the temperature can be rapidly raised to the fixing temperature when the next printing operation begins.

The cold start motor rotatable temperature $T_S$ is the temperature at which toner adhering to and solidified on the cleaner 45 and the stripping blade 44 is melted and the heat roller 41 can be rotated without generating abnormal noises or being damaged during a cold start, that is, when heating the surface of the heat roller 41 with the heater 47 from a temperature below the toner melting temperature $T_m$. In this embodiment, the cold start motor rotatable temperature $T_S$ is the surface temperature of the heat roller 41 at which toner solidified on the cleaner 45 is melted. It should be noted that the cleaner 45 has a greater thermal capacity than the stripping blade 44. The temperature $T_S$ is set to 140° C., for example.

The check temperature $T_C$ is a reference temperature for determining whether to change the setting of the motor start flag (that is, whether to initiate the warm-up operation immediately) when the surface temperature of the heat roller 41 is lower than the cold start motor rotatable temperature $T_S$. The check temperature $T_C$ is set to 110° C., for example. The toner melting temperature $T_m$ is the melting temperature of toner used in the laser printer 1 and is set to 100° C., for example.

A personal computer (PC) 64 is connected to the interface 56 as an external device. The engine 57 is configured of various mechanical components for executing a printing process, including the main motor 65 for driving the heat roller 41 and the like to rotate, the thermistor 43, and the heater 47.

While power is being supplied to the laser printer 1, the warm-up operation determining program monitors the need to perform a warm-up operation (every 10 msec for example) and, when a warm-up operation is necessary, determines whether or not to immediately control the maim motor 65 to drive.

Next, a warm-up operation determining process will be described in detail with reference to the flowcharts in FIGS. 4 and 5.

Figure 4:
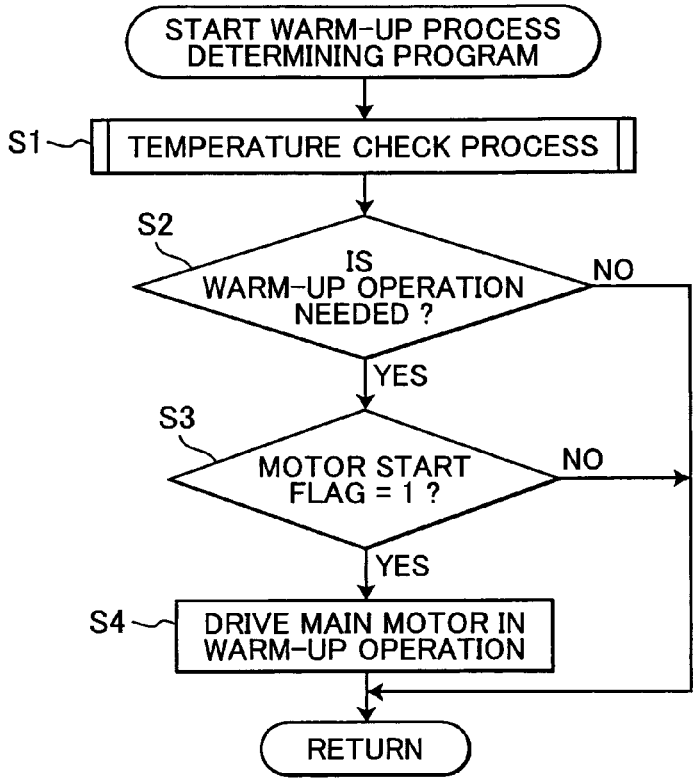
FIG. 4 is a flowchart representing a warm-up operation determining process executed in the laser printer in FIG. 1.

At the beginning of the warm-up operation determining process shown in FIG. 4, the temperature check process program is launched in S1 to initiate a temperature check process for checking the surface temperature of the heat roller 41. FIG. 5 shows the flowchart representing the temperature check process.

Figure 5:
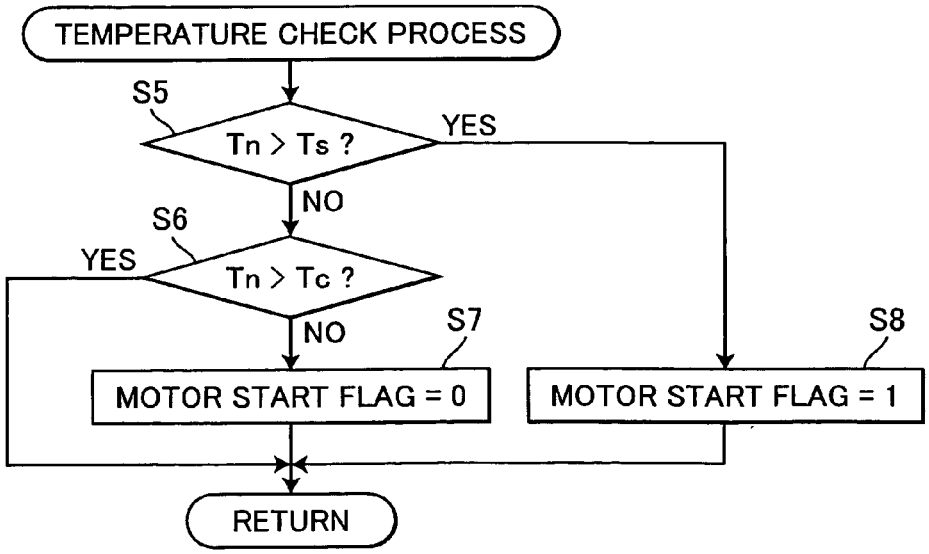
FIG. 5 is a flowchart representing a temperature check process executed in S1 of the warm-up operation determining process of FIG. 4.

At the beginning of the temperature check process, as shown in FIG. 5, the CPU 59 determines in S6 whether a current surface temperature $T_n$ of the heat roller 41 detected by the thermistor 43 is higher than the cold start motor rotatable temperature $T_S$.

If the surface temperature $T_n$ of the heat roller 41 is higher than the cold start motor rotatable temperature $T_S$ (S5:YES), then in S8, the motor start flag stored in the RAM 61 is set to 1, and the temperature check process ends. On the other hand, if the surface temperature $T_n$ of the heat roller 41 is not higher than the cold start motor rotatable temperature $T_S$ (S5:NO), then in S6, the CPU 59 determines whether or not the surface temperature $T_n$ of the heat roller 41 is higher than the check temperature $T_C$.

If the surface temperature $T_n$ of the heat roller 41 is not higher than the check temperature $T_C$ (S6:NO), then in S7, the motor start flag stored in the RAM 61 is set to 0, and the temperature check process ends. On the other hand, if the surface temperature $T_n$ of the heat roller 41 is higher than the check temperature $T_C$ (S6:YES), then the motor start flag is not reset, but is maintained at the same value set in the previous temperature check process, and the temperature check process ends.

Here, it should be noted that when the laser printer 1 is first turned ON, the motor start flag is initialized to 0.

After completing the temperature check process of S1, the CPU 59 determines in S2 of FIG. 4 whether or not a warm-up operation is necessary.

Cases in which the warm-up operation is determined to be necessary include when the power to the laser printer 1 is turned ON, when the laser printer 1 is reset, when a print job is inputted after a fixed time has elapsed since completing the previous printing process (waking from a sleep state), when an error such as a paper jam is cleared, and when the front cover 2*a* in an open state is closed.

When the CPU 59 determines that the warm-up operation is not necessary (S2:NO) then the process of the warm-up operation determining program ends. On the other hand, if the CPU 59 determines that the warm-up operation is necessary (S2:YES), the warm-up operation is started or continued if already started. Specifically, the CPU 59 turns ON the heater 47 to heat the surface of the heat roller 41. Next, the CPU 59 determines in S3 whether or not the motor start flag in the RAM 61 is 1.

If the motor start flag is not 1 (S3:NO), that is, when the motor start flag is 0, then the warm-up operation determining process is ended without controlling the main motor 65 to drive. On the other hand, if the motor start flag is 1 (S3:YES), then in S4 the main motor 65 drives, and the process of the warm-up operation determining program ends.

It should be noted that once the warm-up operation is determined to be necessary in S2, then it is determined in S2 that the warm-up operation is necessary in subsequent determining processes in S2 unless the main motor 65 drives in S4 thereafter.

Figures 6A, 6B, 6C, 6D:
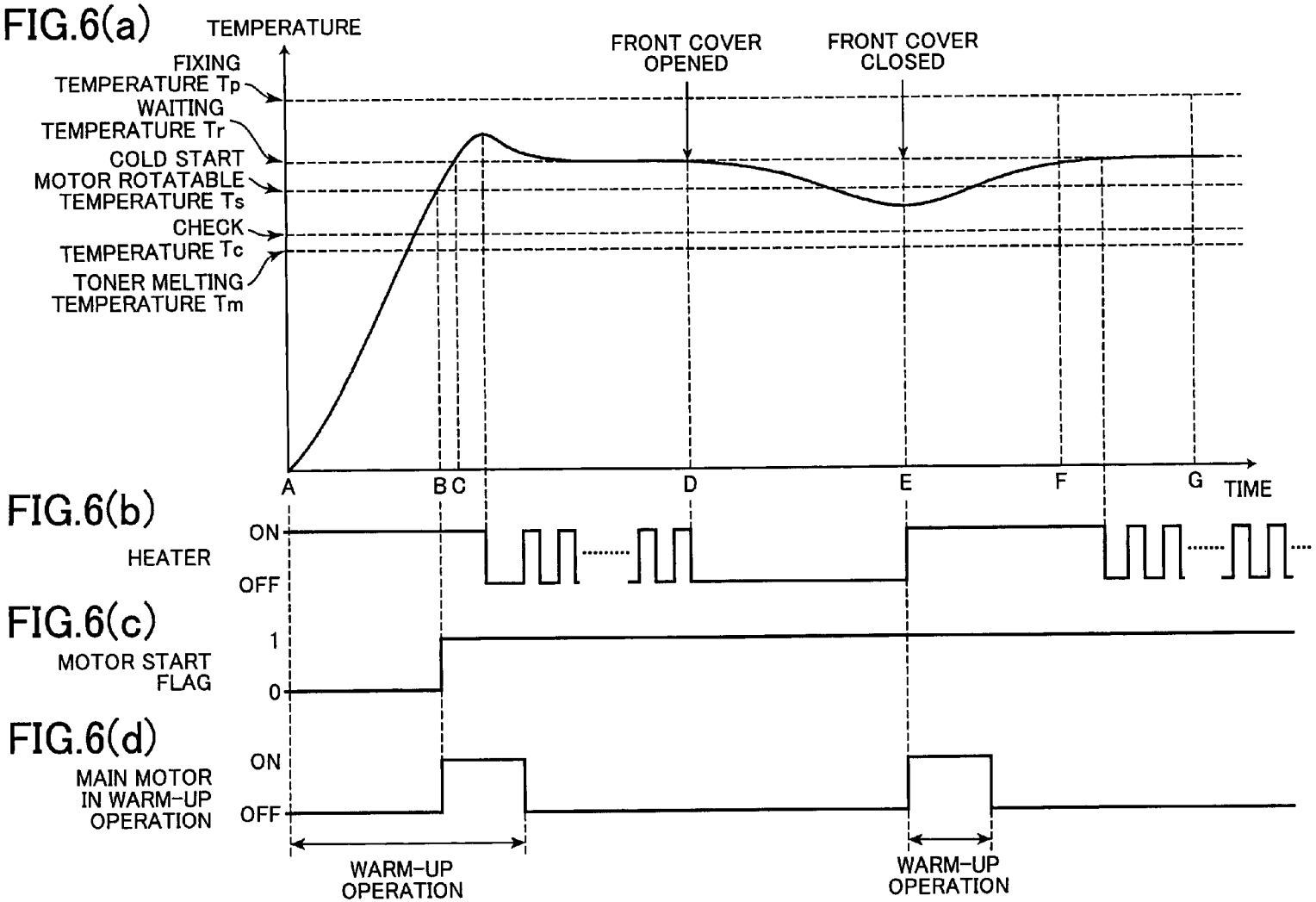
FIG. 6(*a*) is a graph showing an example of temperature variations in relation to time for the surface temperature of a heat roller detected by a thermistor.

Next, the warm-up operation determining process will be described in greater detail with reference to FIGS. 6(*a*) to 6(*d*). FIG. 6(*a*) is a graph showing an example of temperature variations in relation to time for the surface temperature of the heat roller 41 detected by the thermistor 43.

When the power of the laser printer 1 is turned ON, the warm-up operation determining process is repeatedly executed to continuously monitor the need to execute the warm-up operation. Also, based on the print control program and detection signals from the thermistor 43, as shown in FIG. 6(*b*), the CPU 59 controls ON and OFF of the heater 47 to maintain the surface temperature $T_n$ of the heat roller 41 at the waiting temperature $T_r$. By maintaining the surface temperature $T_n$ of the heat roller 41 at the waiting temperature $T_r$ slightly lower than the fixing temperature $T_p$ in this way, it is possible to conserve energy when not performing a printing process (during a non-fixing operation). Further, high-speed printing operations can be maintained by quickly raising the temperature from the waiting temperature $T_r$ to the fixing temperature $T_p$ when performing a printing process (during a fixing operation).

As mentioned above, when the power to the laser printer 1 is turned ON, the CPU 59 determines that a warm-up operation is necessary in FIG. 4 (S2:YES) and starts the warm-up operation. At this time, the motor start flag is initialized to 0. Accordingly, the main motor 65 is not driven to rotate at this point (S3:NO) after the heater 47 begins to heat the heat roller 41 until the surface temperature of the heat roller 41 reaches the cold start motor rotatable temperature $T_S$ (that is, the main motor is not driven between points A and B in FIG. 6(*a*)).

Accordingly, the heat roller 41 is not driven to rotate while solidified toner is adhering to the stripping blade 44 and the cleaner 45, so as to prevent the generation of abnormal noise or damage to the heat roller 41, the stripping blade 44, or the cleaner 45 caused by solidified toner sliding over the surface of the heat roller 41.

The surface temperature $T_n$ of the heat roller 41 is increased to the toner melting temperature $T_m$ and further to the cold start motor rotatable temperature $T_s$ (point B). When the surface temperature $T_n$ of the heat roller 41 is subsequently determined to be higher than the cold start motor rotatable temperature $T_S$ (S5:YES), the motor start flag is set to 1 (S8) as shown in FIG. 6(*c*). Based on the motor start flag being set to 1 (S3:YES), the main motor 65 is controlled to drive in the warm-up operation (S4) (point B, FIG. 6(*d*)).

Because the toner adhering to the stripping blade 44 and the cleaner 45 has melted by the time of when the surface temperature of the heat roller 41 reaches the cold start motor rotatable temperature $T_S$, the heat roller 41 can be driven to rotate without generating noise or causing damage during the warm-up operation.

When the surface temperature $T_n$ of the heat roller 41 subsequently reaches the waiting temperature $T_r$ (point C), the CPU 59 maintains the surface temperature $T_n$ at the waiting temperature $T_r$ by controlling ON and OFF of the heater 47.

When the front cover 2*a* is subsequently opened (point D), for example, the CPU 59 turns OFF the heater 47, gradually lowering the surface temperature $T_n$ of the heat roller 41. The process determines that the warm-up operation is necessary when the front cover 2*a* is closed (S2: YES), and the CPU 59 turns ON the heater 47 to start the warm-up operation (S3). The front cover 2*a* may be closed before the surface temperature $T_n$ drops below the check temperature $T_c$ or after the surface temperature $T_n$ drops below the check temperature $T_c$.

If the front cover 2*a* is closed before the surface temperature $T_n$ drops below the check temperature $T_C$ (point E) as shown in FIG. 6(*a*), although the surface temperature $T_n$ is lower than the cold start motor rotatable temperature $T_S$ (S5:NO), the CPU 59 determines that the surface temperature $T_n$ is higher than the check temperature $T_C$ (S6:YES). Hence, the setting for the motor start flag is not changed and remains 1 as shown in FIG. 6(*c*), so that the main motor 65 starts driving immediately after the warm-up process is started (S3:YES, S4) without waiting the surface temperature $T_n$ to reach the cold start motor rotatable temperature $T_S$.

In other words, toner that has adhered to and solidified on the stripping blade 44 and the cleaner 45 is sufficiently melted by the time the temperature has reached the cold start motor rotatable temperature $T_S$ (point D). Hence, even if the temperature drops below the cold start motor rotatable temperature $T_S$, the toner is maintained in a molten state when the front cover 2*a* is closed (point E) due to the sufficient amount of heat applied prior to that point (point E), provided that the temperature does not drop below the check temperature $T_C$.

Hence, when the front cover 2*a* is closed (point E), the driving of the main motor 65 in the warm-up operation can be started immediately and the heat roller 41 can be driven to rotate without abnormal noise or damage occurring due to solidified toner. Subsequently, a high-speed printing process can be performed while ensuring that the heat roller 41 is reliably driven to rotate.

Figures 7A, 7B, 7C, 7D:
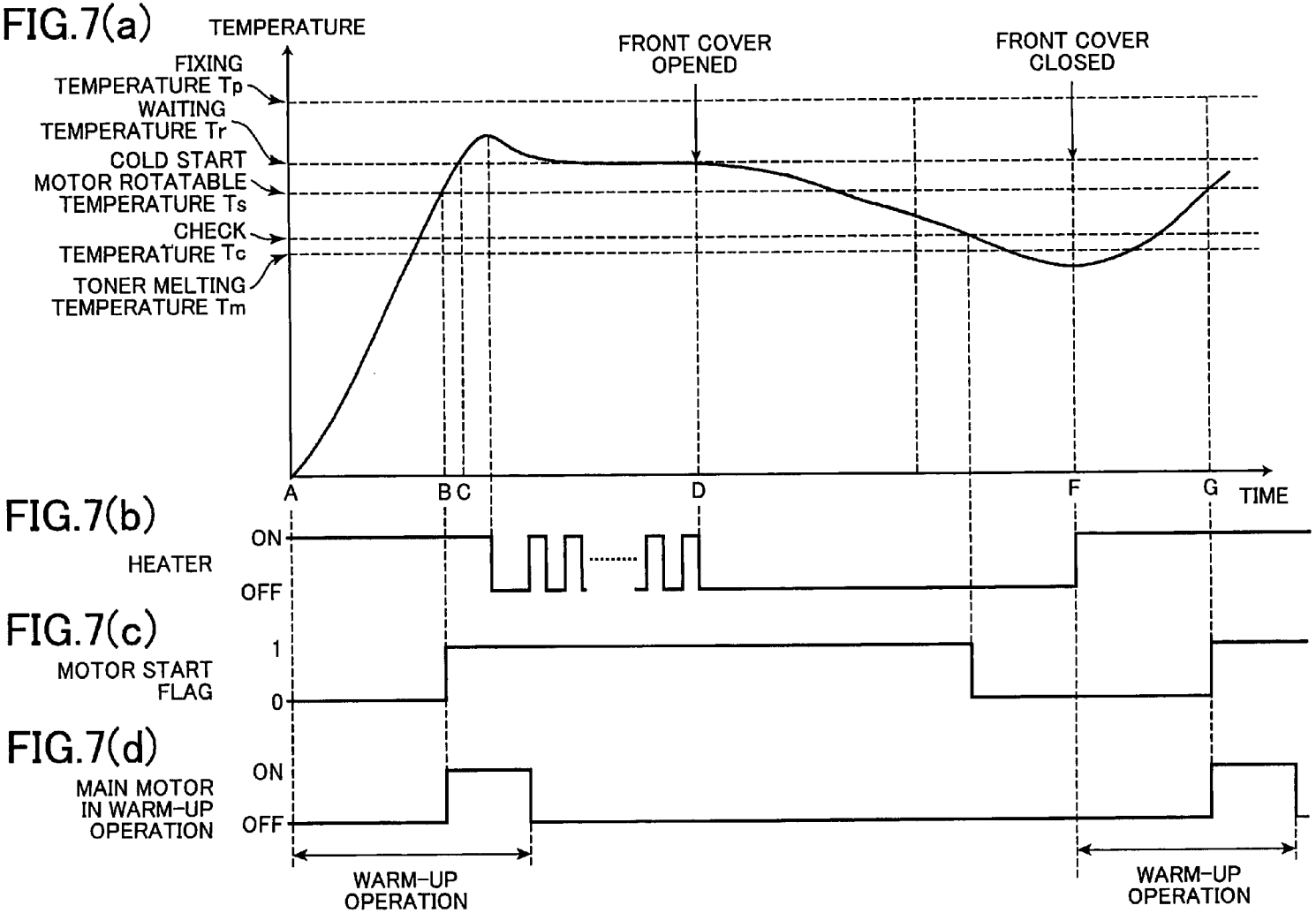
FIG. 7(*a*) is a graph showing another example of temperature variations in relation to time for the surface temperature of the heat roller detected by the thermistor.

On the other hand, if as shown in FIG. 7(*a*) the front cover 2*a* is closed at point F after the surface temperature $T_n$ drops below the check temperature $T_C$, the motor start flag is set to 0 (S7) by the time of when the front cover 2*a* is closed as shown in FIG. 7(*c*).

Therefore, the CPU 59 waits until the surface temperature $T_n$ reaches the cold start motor rotatable temperature $T_S$ (point G) after turning ON the heat roller 41 (FIG. 7(*b*)). That is, as shown in FIG. 7(*d*), the main motor 65 does not start driving in the warm-up operation until the surface temperature $T_n$ exceeds the start motor rotatable temperature $T_S$ (S5:YES) and the motor start flag is set to 1 (S8).

In other words, even if the surface temperature $T_n$ of the heat roller 41 previously reached the cold start motor rotatable temperature $T_S$, toner adhering to the stripping blade 44 and the cleaner 45 becomes cooled if the temperature subsequently drops below the check temperature $T_C$. Accordingly, the main motor 65 does not start driving immediately after the warm-up operation is started After the cooled toner is sufficiently heated, such that the surface temperature $T_n$ of the heat roller 41 again reaches the cold start motor rotatable temperature $T_S$, then the main motor 65 starts driving in the warm-up operation. In doing so, the heat roller 41 can be driven to rotate without generating noise or causing damage due to cooled toner.

In this way, the heat roller 41 is driven to rotate at the precise time in the warm-up operation based on the prior status of the surface temperature of the heat roller 41. Accordingly, a high-speed printing process can be performed by achieving a high-speed warm-up operation while ensuring that the heat roller 41 is driven to rotate reliably.

Because the check temperature $T_C$ is set at a temperature in which toner adhering to the cleaner 45 and the stripping blade 44 is melted and the heat roller 41 can be rotated for a cold start, it is possible to achieve prompt control based on the actual molten state of the toner adhering to the cleaner 45 and the stripping blade 44. Accordingly, the heat roller 41 can be reliably prevented from being driven while toner adhering to the cleaner 45 and the stripping blade 44 has not melted, thereby preventing abnormal noises and damage from occurring due to the scraping by unmelted toner.

In particular, the cleaner 45 has a larger thermal capacity than the stripping blade 44, and the cold start motor rotatable temperature $T_S$ is set as a reference based on the surface temperature $T_n$ of the heat roller 41 at which solidified toner adhering to the cleaner 45 melts. That is, toner adhering to the cleaner 45, which melts slower than toner adhering to the stripping blade 44, is used as a reference. Then, the driving of the heat roller 41 (main motor 65) is initiated in the warm-up operation based on the reference. Accordingly, the laser printer 1 can reliably prevent abnormal noise and damages from occurring due to the sliding of unmelted toner.

If the cleaner 45 is not provided in the laser printer 1, then the cold start motor rotatable temperature $T_S$ can be set as the surface temperature of the heat roller 41 capable of melting toner adhering to the stripping blade 44 or the thermistor 43 having the larger thermal capacity.

Next, a modification of the above-described embodiment will be described with reference to FIGS. 8(*a*) to 8(*d'*). In the above-described embodiment, it is determined whether or not to start driving the maim motor 65 in the warm-up operation based on the status of the motor start flag and current temperature of the heat roller 41. However, in this modification, the main motor 65 is controlled in the following manner during the warm-up operation.

Figures 8A, 8B, 8C, 8D:
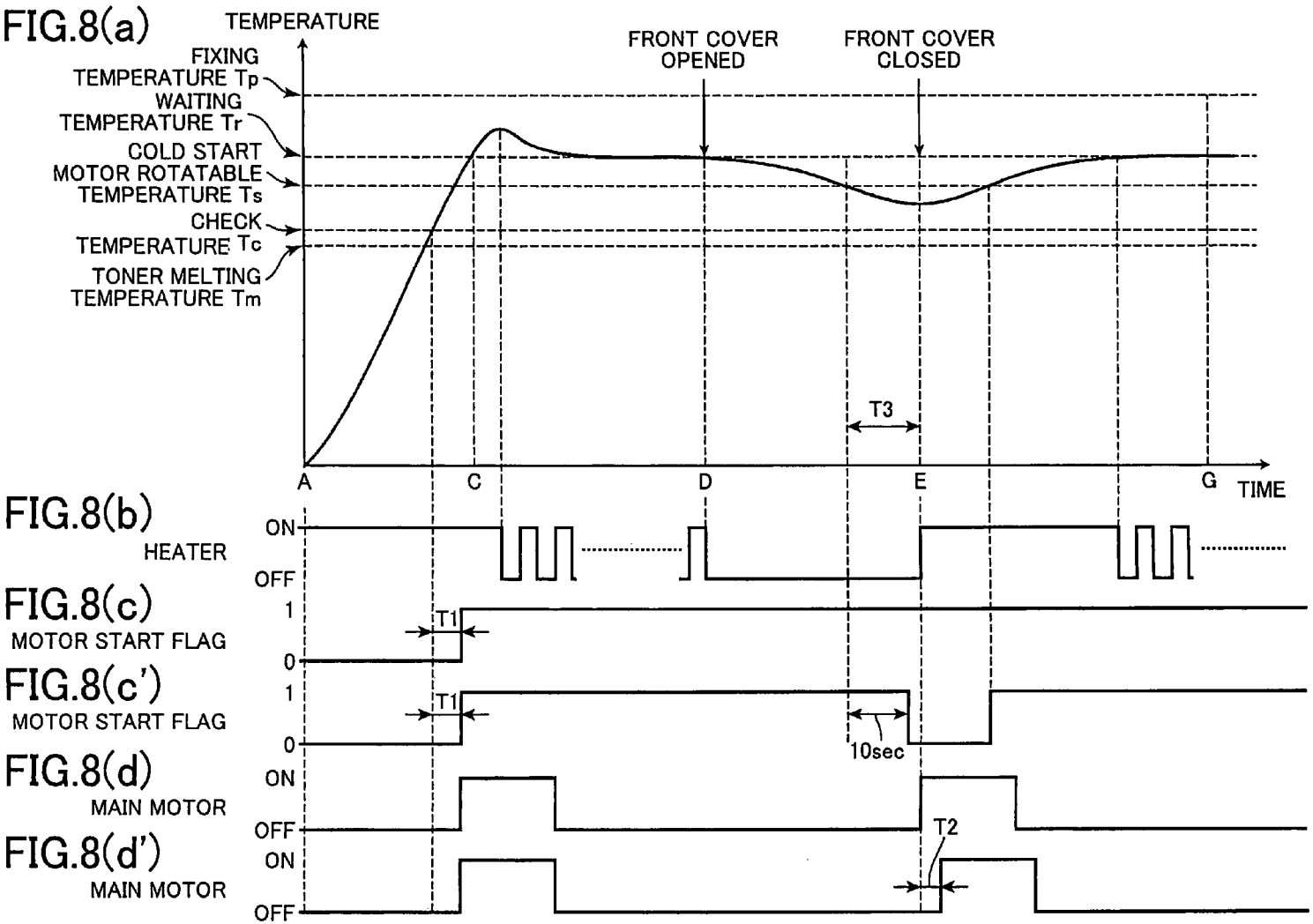
FIG. 8(*a*) is a graph showing an example of temperature variations in relation to time for the surface temperature of a heat roller detected by the thermistor.

That is, if the warm-up operation is started when the motor start flag is not 1 and the surface temperature $T_n$ of the heat roller 41 is below the check temperature $T_c$ (point A in FIG. 8(*a*)), then as shown in FIG. 8(*c*), the motor start flag is set to 1 when a first predetermined time T1 elapses after the surface temperature $T_n$ has reached the check temperature $T_c$. Thus, as shown in FIG. 8(*d*), the main motor 65 starts rotating when the first predetermined time T1 elapses after the surface temperature $T_n$ has reached the check temperature $T_c$. The first predetermined time T1 could be three, seconds, for example.

When the front cover 2*a* is subsequently opened (point D), for example, the CPU, 59 turns OFF the heater 47 as shown in FIG. 8(*b*), gradually lowering the surface temperature $T_n$ of the heat roller 41. If 10 seconds elapses after the surface temperature $T_n$ has dropped to the cold start motor rotatable temperature $T_s$, then the motor start flag is set to 0 as shown in FIG. 8(*c'*). Otherwise, the motor start-flag is maintained at 1 as shown in FIG. 8(*c*).

When the front cover 2*a* is closed at point E in FIG. 8(*a*), then the CPU 59 starts the warm-up operation and turns ON the heater 47 as shown in FIG. 8(*b*). It is assumed that the front cover 2*a* is closed before the surface temperature $T_n$ drops below the check temperature $T_c$. It the motor start flag is 1 when the front cover 2*a* is closed as shown in FIG. 8(*c*), then as shown in FIG. 8(*d*) the main motor 65 starts driving immediately after the warm-up operation is started. On the other hand, if the motor start flag has already been set to 0 by the time of closing the front cover 2*a* as shown in FIG. 8(*c'*), then as shown in FIG. 8(*d'*) the main motor 65 starts driving in the warm-up operation when a second predetermined time T2 elapses after the heater 47 was turned ON. The second predetermined time T2 is shorter than the first predetermined time T1.

That is, if a time duration T3 (FIG. 8(*a*)) between when the surface temperature Tn has dropped below the cold start motor rotatable temperature Ts and when the warm-up operation is started is shorter than 10 seconds, then the main motor 65 is controlled to start rotating immediately after the warm-up operation is started. On the other hand, if the time duration T3 is equal to or longer than 10 seconds, then the main motor 65 is controlled to start rotating the heat roller 41 and the like when the second predetermined time T2 elapses after the warm-up operation has been started.

In this modification also, driving of the heat roller 41 can be initiated precisely according to the prior heating status of the heat roller 41, thereby achieving a high-speed printing process while ensuring reliably driving of the heat roller 41.

While the invention has been described in detail with reference to specific embodiments thereof, it would be apparent to those skilled in the art that many modifications and variations may be made therein without departing from the spirit of the invention, the scope of which is defined by the attached claims.

For example, in the embodiment described above, the cold start motor rotatable temperature $T_S$ is set to a temperature lower than the waiting temperature $T_r$. However, the cold start motor rotatable temperature $T_S$ could be set to the same temperature as the waiting temperature $T_r$. In this case also, energy can be conserved while not performing a printing process (during a non-fixing operation). Further, high-speed printing processes can be ensured by, rapidly raising the temperature from the waiting temperature to the fixing temperature $T_p$ before performing a printing process (fixing operation).

In the embodiment described above, the check temperature $T_C$ is set to a temperature lower than the toner melting temperature $T_m$. However, the check temperature $T_C$ could be set to the same temperature as the toner melting temperature $T_m$. In this case, it is possible to ensure that driving to rotate the heat roller 41 is more rapidly initiated over a broader temperature range than when the check temperature $T_C$ is set higher than the toner melting temperature $T_m$.

In the embodiment described above, the temperature at both axial ends of the heat roller 41 rises slower than in the center portion, in which the thermistor 43 is disposed, during the cold start between points A and C in FIG. 6(*a*). The surface temperature at both ends is some 10° C. lower than the surface temperature at the center. However, as the temperature is maintained at the waiting temperature $T_r$ during the period following the point C, the surface temperature becomes uniform over the entire axial range of the heat roller 41. Accordingly, toner adhering to and solidified on the axial ends of the heat roller 41 and the stripping blade 44 can take slightly longer to melt than toner adhering to the center portion. Therefore, it is desirable that the actual control takes into consideration the delay for melting this type of toner.

In the above-described embodiment, an example was given for a monochrome laser printer 1, but the present invention can also be applied to a color laser printer. Further, in the above-described embodiment, a single thermistor 43 is disposed in the center of the heat roller 41 with respect to the axial direction of the hat roller 41. However, a plurality of thermistors 43 may be used to detect the surface temperature at the center and ends of the heat roller 41.

What is claimed is:

1. An image forming device comprising:

a fixing member that performs a fixing operation to fix a developer onto a fixing medium, the fixing member having a surface, the developer having a melting temperature that is a first temperature;

a heater that generates heat to heat the fixing member;

a first detecting member that detects a surface temperature of the fixing member;

a driving member that rotates the fixing member;

a contact member that constantly contacts the surface of the fixing member;

a controller that controls the heater and the driving member, the controller determines whether or not the surface temperature of the fixing member has dropped below a third temperature after the surface temperature has previously reached a second temperature higher than the first temperature, the third temperature being equal to or higher than the first temperature and lower than the second temperature, wherein the controller controls the heater to start generating heat at a predetermined timing;

when the surface temperature of the fixing member detected at the predetermined timing by the first detecting member is lower than the third temperature, the controller controls the driving member to start rotating the fixing member after the surface temperature of the fixing member exceeds the second temperature; and when the surface temperature of the fixing member detected at the predetermined timing by the first detecting member has not dropped below the third temperature after the surface temperature has previously reached the second temperature, the controller controls the driving member to start rotating the fixing member.

2. The image forming device according to claim 1, wherein the second temperature is a surface temperature of the fixing member at which a developer adhering to the contact member melts when the fixing member whose surface temperature is lower than the first temperature is heated by the heater.

3. The image forming device according to claim 2, further comprising a plurality of contact members constantly contacting the surface of the fixing member, wherein the second temperature is a surface temperature of the fixing member at which a developer adhering to one of the plurality of contact members having the largest thermal capacity melts when the fixing member whose surface temperature is lower than the first temperature is heated by the heater.

4. The image forming device according to claim 1, wherein the controller controls the heater to maintain the surface temperature of the fixing member at a fixing temperature that is higher than the second temperature during the fixing operation, and the controller controls the heater to maintain the surface temperature of the fixing member at the second temperature during a non-fixing operation.

5. The image forming device according to claim 1, wherein the third temperature is equal to the first temperature.

6. The image forming device according to claim 1, wherein the controller executes a warm-up operation in preparation for a printing process.

7. The image forming device according to claim 1, wherein when the surface temperature of the fixing member detected at the predetermined timing by the first detecting member is lower than the second temperature and when the controller determines that the surface temperature of the fixing member has dropped below the third temperature after the surface temperature has previously reached the second temperature, the controller controls the driving member to start rotating the fixing member after the surface temperature of the fixing member exceeds the second temperature.

8. The image forming device according to claim 1, wherein when the surface temperature of the fixing member detected at the predetermined timing by the first detecting member is higher than the third temperature, the controller controls the driving member to start rotating the fixing member immediately after the controller controlled the heater to start generating heat.

9. An image forming device comprising:

a fixing member that performs a fixing operation to fix a developer onto a fixing medium, the fixing member having a surface, the developer having a melting temperature that is a first temperature;

a heater that generates heat to heat the fixing member;

a first detecting member that detects a surface temperature of the fixing member;

a driving member that rotates the fixing member;

a contact member that constantly contacts the surface of the fixing member;

a controller that controls the heater and the driving member, the controller determines whether or not the surface temperature of the fixing member has dropped below a third temperature after the surface temperature has previously reached a second temperature higher than the first temperature, the third temperature being equal to or higher than the first temperature and lower than the second temperature, wherein the controller controls the heater to start generating heat at a predetermined timing;

when the surface temperature of the fixing member detected, at the predetermined timing, by the first detecting member is lower than the third temperature, the controller controls the driving member to start rotating the fixing member after a first predetermined time has elapsed after the surface temperature of the fixing unit reached the third temperature by controlling the heater; and when the surface temperature of the fixing member detected, at the predetermined timing, by the first detecting member has not dropped below the third temperature after the surface temperature has previously reached the second temperature, the controller controls the driving member to start rotating the fixing member after a second predetermined time has elapsed after the controller controlled the heater to start generating heat, the second predetermined time being shorter than the first predetermined time.

10. The image forming device according to claim 9, wherein the controller controls the driving member to start driving the fixing member immediately after the controller controls the heater to start generating heat when, at the predetermined timing, the controller determines that the surface temperature of the fixing member has not dropped below the third temperature after the surface temperature has previously reached the second temperature and when the predetermined timing is within a third predetermined time after the surface temperature of the fixing member dropped below the second predetermined temperature.

11. The image forming device according to claim 9, wherein the second temperature is a surface temperature of the fixing member at which a developer adhering to the contact member melts when the fixing member whose surface temperature is lower than the first temperature is heated by the heater.

12. The image forming device according to claim 11, further comprising a plurality of contact members constantly contacting the surface of the fixing member, wherein the second temperature is a surface temperature of the fixing member at which a developer adhering to one of the plurality of contact members having the largest thermal capacity melts when the fixing member whose surface temperature is lower than the first temperature is heated by the heater.

13. The image forming device according to claim 9, wherein the controller controls the heater to maintain the surface temperature of the fixing member at a fixing temperature that is higher than the second temperature during the fixing operation, and the controller controls the heater to maintain the surface temperature of the fixing member at the second temperature during a non-fixing operation.

14. The image forming device according to claim 9, wherein the third temperature is equal to the first temperature.

15. The image forming device according to claim 9, wherein the controller executes a warm-up operation in preparation for a printing process.

* * * * *